United States Patent [19]

Humpert et al.

[11] Patent Number: 4,989,633

[45] Date of Patent: Feb. 5, 1991

[54] ADJUSTABLE-LENGTH WALL-MOUNT FAUCET

[75] Inventors: Jürgen Humpert, Hemer; Bruno Heimann, Frondenberg-Ardey; Jan R. Kostorz, Menden, all of Fed. Rep. of Germany

[73] Assignee: Friedrich Grohe Armaturenfabrik GmbH+Co., Hemer, Fed. Rep. of Germany

[21] Appl. No.: 485,380

[22] Filed: Feb. 26, 1990

[30] Foreign Application Priority Data

Mar. 9, 1989 [DE] Fed. Rep. of Germany ..... 3907586

[51] Int. Cl.[5] ..... F16L 5/00

[52] U.S. Cl. ..... 137/360; 137/359; 4/192

[58] Field of Search ..... 137/359, 360; 4/191, 4/192

[56] References Cited

U.S. PATENT DOCUMENTS

| | | | |
|---|---|---|---|
| 2,747,604 | 5/1956 | Fraser | 137/360 |
| 2,878,489 | 3/1959 | Graham | 4/192 |
| 3,034,138 | 5/1962 | Filliung | 4/192 |
| 3,807,453 | 4/1974 | Dom et al. | 137/359 |
| 3,960,016 | 6/1976 | Symmons | 137/359 |
| 4,662,389 | 5/1987 | Igbal | 4/191 |
| 4,848,395 | 7/1989 | Krippendorf | 137/359 |

*Primary Examiner*—A. Michael Chambers

*Attorney, Agent, or Firm*—Herbert Dubno; Andrew Wilford

[57] ABSTRACT

A wall-mount faucet assembly has a wall fitting adapted to be recessed in a wall and having an externally threaded stem projecting from the wall centered on an axis and formed with hot- and cold-water outlet ports. This fitting is formed with hot- and cold-water inlet ports behind the wall. A mixing faucet having an internally threaded collar engageable with the stem is rotatable thereon for axially displacing the faucet on the fitting. The faucet is formed in the collar with hot- and cold-water inlets connected in the fitting to the outlet ports. An adapter engaged in the collar between the faucet and the fitting has hot- and cold-water passages with upstream ends at the respective outlet ports and downstream ends at the respective inlets. The downstream ends are concentric such that the inlets connect thereto in any angular position of the faucet on the fitting. A locking unit is engageable between the faucet and the fitting for fixing the faucet on the fitting against rotation thereon in any relative angular position.

12 Claims, 3 Drawing Sheets

ADJUSTABLE-LENGTH WALL-MOUNT FAUCET

FIELD OF THE INVENTION

The present invention relates to a wall-mount plumbing fitting. More particularly this invention concerns a wall-mount mixing faucet.

BACKGROUND OF THE INVENTION

A standard wall-mounted mixing faucet assembly is provided with a faucet formed with hot- and cold-water inlets and a mixed-water outlet, a valve for connecting the inlets to the outlet, and an actuating member for the valve. This faucet is carried on a wall-mounted fitting that is secured in the wall and that is formed with hot- and cold-water couplings as well as hot- and cold-water outlet ports. The couplings are behind the wall surface to which the fitting is secured and are connected to the incoming water lines. The ports are exposed at the wall and mate with the inlets of the faucet, and means is provided for securing the faucet on the fitting with the inlets over the ports.

Normally the wall-mounted fitting is mounted in place when the plumbing hookup is roughed in. Then the wall panel, typically moisture-resistant gypsum board, is fitted around the adapter fitting and the wall covering, for instance tile, is applied to the wall panel. Only then is the faucet secured to this fitting.

Provision must be made to accommodate different wall thicknesses between the wall-mounted fitting and the faucet. For instance a common wall in a multiple dwelling may have two layers of $\frac{5}{8}''$ gypsum board plus $\frac{1}{2}''$ of ceramic tile for a total thickness of $1\frac{3}{4}''$ while cheaper construction could have a single layer of $\frac{3}{8}''$ gypsum board covered with a membrane wall covering of insignificant thickness for a total thickness of about $\frac{3}{8}''$. Since the plumber doing the rough-in often has no clue about the final wall treatment, the adapter fitting must be able to accommodate a relatively wide range of wall thicknesses while still ensuring that the faucet will sit snugly on the wall and that the connections to the faucet will not leak.

Thus as described in U.S. Pat. Nos. 3,880,183 and 4,846,207 various spacers are used as part of the adapter fitting. All of the spacers are employed for the thickest possible wall and none for the thinnest. Such an arrangement requires that the installer keep track of these various parts prior to installation and, unless they are saved, any subsequent change in wall covering will normally require a new kit to be obtained. Furthermore the adapter length is set in steps so that obtaining a snug fit of the faucet to the wall is unlikely unless by chance the wall thickness corresponds exactly to one of the settings for the adapter.

Another problem with the known installations is that it is necessary to assemble the entire faucet assembly to test the lines, in particular the last joint between the risers and the wall fitting, and to verify that the hot and cold are connected to the right sides. Thus the faucet assembly must be put entirely together, then disassembled so that the wall can be finished.

OBJECTS OF THE INVENTION

It is therefore an object of the present invention to provide an improved mixing faucet assembly.

Another object is the provision of such an improved mixing faucet assembly which overcomes the above-given disadvantages, that is which is easy to adjust to different wall thicknesses.

A further object is to provide such an assembly which can be tested and even bled without having to assemble the entire faucet.

SUMMARY OF THE INVENTION

A wall-mount faucet assembly according to this invention has a wall fitting adapted to be recessed in a wall and having an externally threaded stem projecting from the wall centered on an axis and formed with hot- and cold-water outlet ports. This fitting is formed with hot- and cold-water inlet ports behind the wall. A mixing faucet having an internally threaded collar engageable with the stem is rotatable thereon for axially displacing the faucet on the fitting. The faucet is formed in the collar with hot- and cold-water inlets connected in the fitting to the outlet ports. An adapter engaged in the collar between the faucet and the fitting has hot- and cold-water passages with upstream ends at the respective outlet ports and downstream ends at the respective inlets. The downstream ends are concentric such that the inlets connect thereto in any angular position of the faucet o the fitting. A locking unit is engageable between the faucet and the fitting for fixing the faucet on the fitting against rotation thereon in any relative angular position.

Thus with this system the wall fitting is mounted in place and the faucet can subsequently be mounted thereon in any angular position. The inlet ports can therefore be arranged at any convenient angle and the finished assembly will nonetheless be oriented properly.

According to another feature of this invention the locking unit includes an axially centered generally frustoconical surface on the collar, a ring with a complementary surface engageable with the collar surface, and means for axially bracing the ring against the wall and thereby pressing the surfaces tightly together so as to block rotation of the faucet on the fitting. This last-mentioned means can include a plurality of angularly spaced screws threaded through the ring and axially operatively engageable with the fitting and another ring threaded on the stem. The screws are axially braced against this other ring.

The collar according to this invention has a large-diameter outer end portion formed with the respective thread and an inner smaller-diameter portion. Similarly the thread has a large-diameter inner portion formed with the respective thread and an outer smaller-diameter portion juxtaposed with the smaller portion of the collar. A seal is provided between the smaller portions and the adapter has an inner sleeve defining with the smaller portion of the collar an annular opening constituting one of the downstream ends and internally forming the other downstream end and the collar also has an inner sleeve internally delimiting one of the inlets and internally defining the other inlet. The inner sleeves axially telescope and are provided with a seal.

The outlet ports of the stem are provided internally with removable sound-damping devices, check valves, filters, or the like removable via the outlet ports. In addition the fitting is provided between each of the inlet ports and the respective outlet port with a cutoff valve, in which case the assembly further has a cover rosette fixable on the collar and against the wall over the cutoff valves. This cover rosette has a seal ring engageable against the wall around the fitting. In addition the cover rosette includes a mounting ring snugly engageable over the collar and having a curved outer surface with a center of curvature lying generally on the axis and the rosette includes a plate having an inner periphery with an inner edge having a surface complementary to and engaging the curved outer surface of the mounting ring. This plate is tiltable on the mounting ring, thus even if the stem does not extend perfectly perpendicular to the wall, the cover rosette can adjust for this and make a tight seal with the wall.

In accordance with a further feature of this invention a shield engageable over the fitting is formed with nipples engageable with and forming extensions of the outlet ports. This shield therefore protects the wall fitting during construction of the wall and even allows the valve to be tested and bled without having to mount the faucet on it.

The outlet ports according to the invention are symmetrically opposite each other with respect to the axis and the adapter and the adapter can fit on the stem in 180° offset positions for reversing the connections between the outlet ports and the inlets.

DESCRIPTION OF THE DRAWING

The above and other objects, features, and advantages will become more readily apparent from the following, reference being made to the accompanying drawing in which.

SPECIFIC DESCRIPTION

Figure 1:
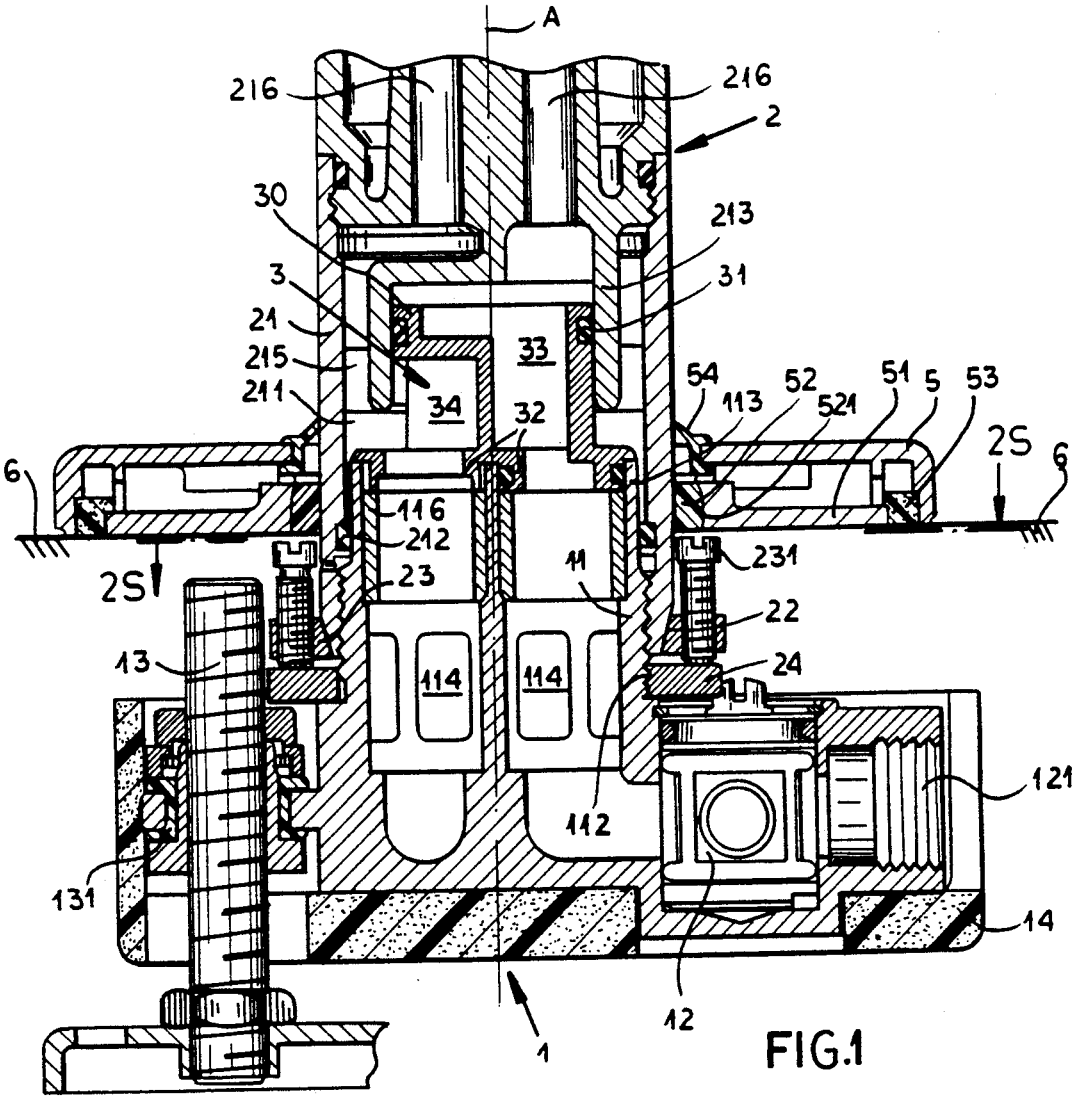
FIG. 1 is a section taken along line 1S—1S of FIG. 2 showing the valve adjusted for a thin wall.
Figure 2:
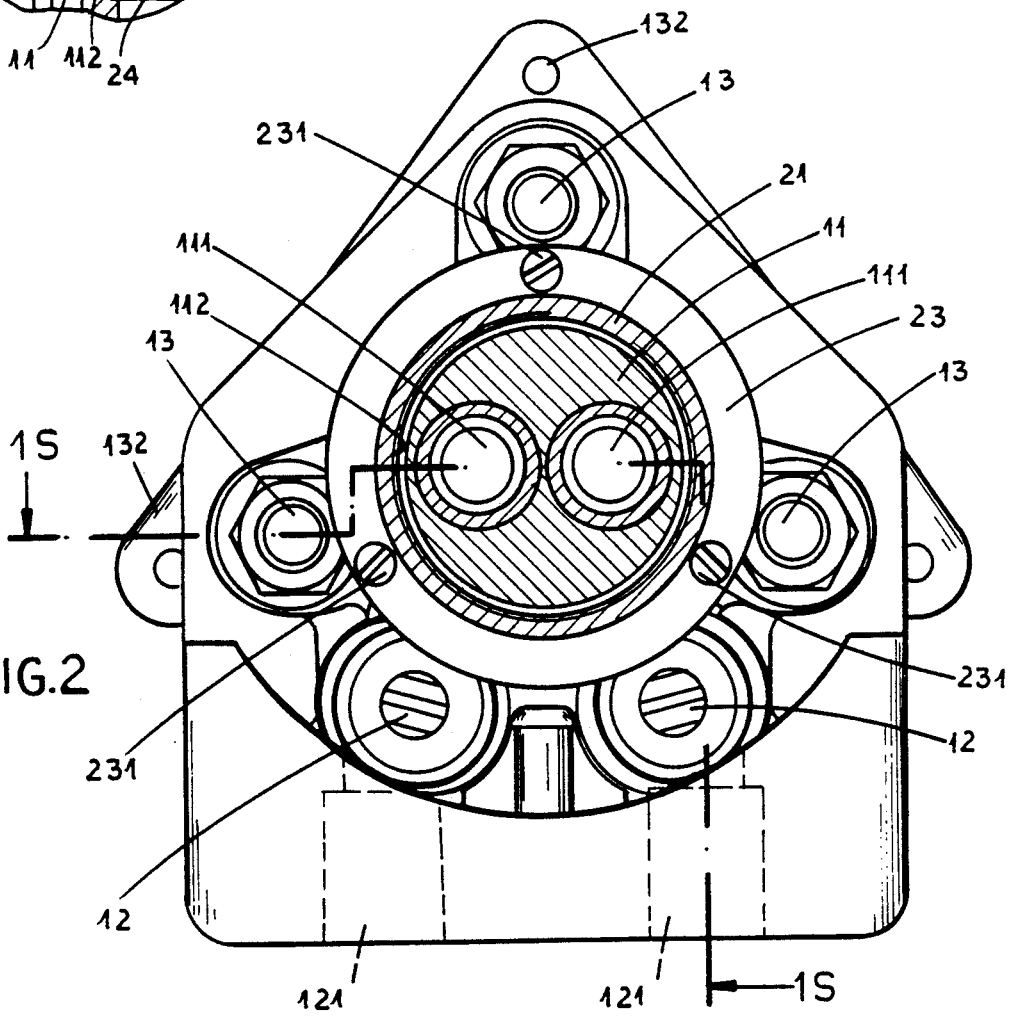
FIG. 2 is a section taken along line 2S—2S of FIG.1.
Figure 3:
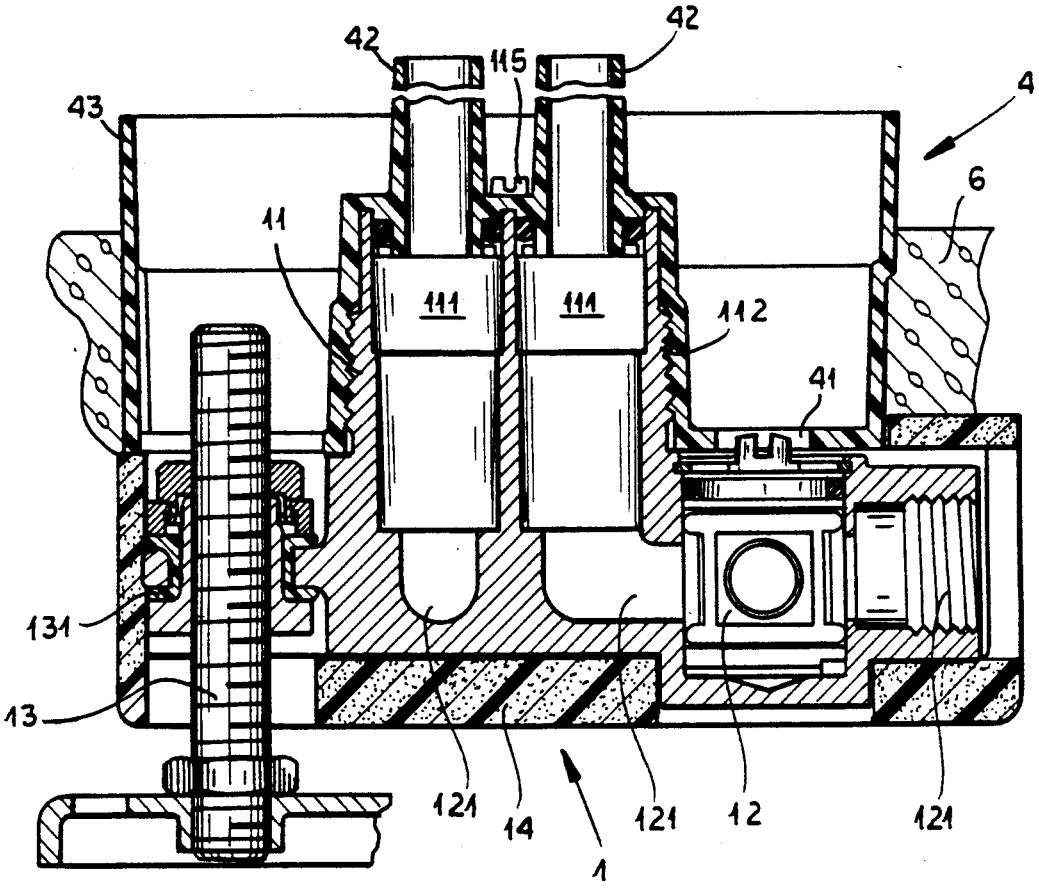
FIG. 3 is an axial section showing the wall fitting and the disposable template/shield.

As seen in FIGS. 1 through 3 a faucet assembly according to this invention basically comprises a wall fitting 1, a faucet 2, an adapter 3, and a cover plate or rosette 5. A shield/template 4 (FIG. 3 only) is used for installing the assembly in a wall 6.

The wall fitting 1 has two L-shaped passages 121 opening at upstream ends parallel to each other and to the wall 6 and at downstream ends also parallel to each other but perpendicular to the wall 6 at a tubular stem 11 where they form hot- and cold-water ports 111 flanking an axis A. Immediately downstream of each upstream end each passage 121 is provided with a barrel-type flow-control valve 12 of the type that is operated by a screwdriver and that can be used to limit flow through the respective passage 121 and also to completely block flow when rotated through 90°. Furthermore each passage 121 is provided with a respective sound damper 114 held in place via a spacer sleeve 116 which itself can be replaced by a check valve, filter, or the like. The sleeves 116 and dampers 114 can be pulled out the downstream ends of the respective passages 121 for servicing the valve after it is installed.

This fitting 1 is mounted in the wall 6 either by means of bolts 13 seated in shock-absorbing washers 131, or is simply screwed in place via lugs 132 (FIG. 3). The back of the fitting 1 is covered with a layer 14 of foam-type sound-deadening material. The stem 11 of the fitting 1 itself is formed with the ports 111 and has a thin-walled outer portion 113 with a cylindrical outer surface and a larger-diameter threaded inner portion 112.

Figure 1A:
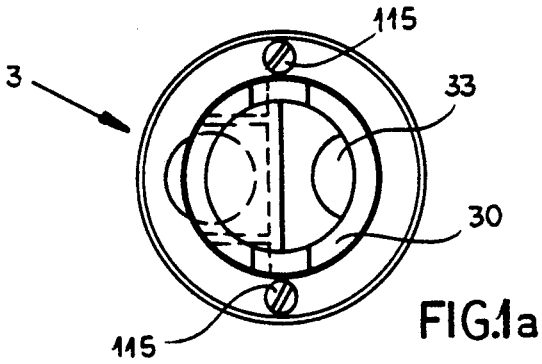
FIG. 1*a* is an end view of the wall fitting and adapter of this invention.
Figure 1B:
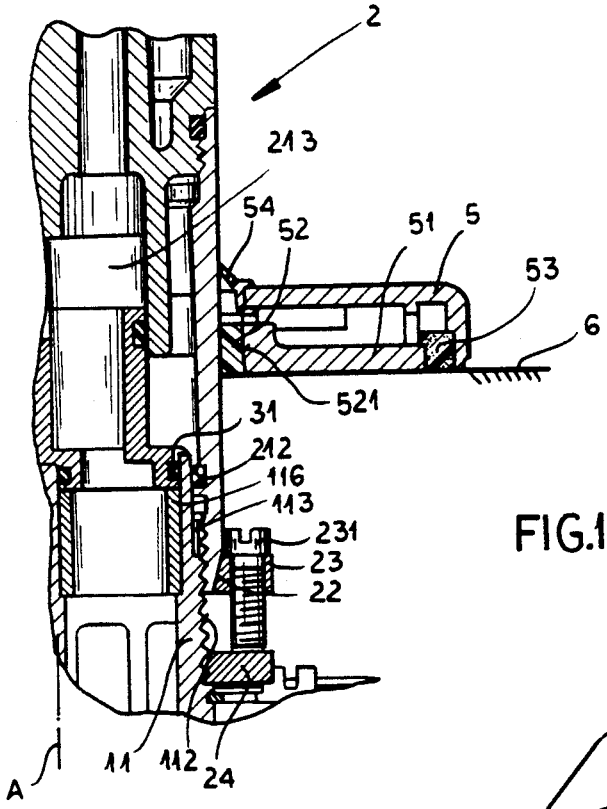
FIG. 1*b* is a detail corresponding to the upper right-hand portion of FIG. 1, but with the valve adjusted for a thick wall.

The adapter 3 has an upstream end formed with a pair of stubby collars 32 that fit tightly into the ports 111. At its downstream end 30 the adapter 3 is tubular and centered on the axis A. This adapter 3 formed with one passage 33 extending between one of the collars 32 and the tubular end 30 and another passage 34 that opens upstream at the other collar 32 and downstream behind the tubular end 30, maintaining the hot and cold flows separate. Two diametrally opposite screws shown at 115 in FIG. 1*a* secure this adapter 3 tightly atop the stem 11.

The faucet 2 has at its rear end an extension sleeve 21 that is centered on the axis A and formed internally with threads complementary to those of the portion 112 of the stem 11. Internally this sleeve 21 has centered on the axis A an inner sleeve 213 that fits complementarily over the end 30 of the adapter 3, an O-ring 31 being provided in the end 30 for sealing between the two. An O-ring seal 212 engages between the outside of this sleeve 21 and the thin-walled portion 113 of the stem 11. The inner sleeve 213 forms the upstream end of a hot-water passage 214. A cold-water passage 216 separate from the passage 214 opens into an annular opening 215 delimited inwardly by the sleeve 213 and opening into a space 211 into which the passage 34 opens. Thus flow from the one inlet passage 121 is diverted into the passage 214 and from the other inlet passage 121 into the passage 216, the two flows being kept separate at all times.

At its rear end the extension sleeve 21 is formed with an inwardly tapering frustoconical surface 22 that can fit in an oppositely flared ring 23 that is axially traversed by three angularly equispaced screws 231. A ring 24 threaded on the threaded portion 112 acts as a seat for these screws 231 as will be described below.

The cover plate 5 comprises a synthetic-resin ring 52 with a barrel-shaped outer surface 521 having a center of curvature at the axis A and complementary to the inner periphery of a back ring 51. A foam ring 43 is set into this back ring 51 to engage the wall 6 tightly and form therewith a watertight connection. The plate 5 has a lip-type seal 54 at its inner edge outward of the ring 52 that engages the outer surface of the collar 21 and that can deform readily.

On installation the inlet ports 121 are connected to the hot- and cold-water lines and the fitting 1 is fixed in the wall 6 with the template 4 secured to it by the screws 115. This template 4 is formed with holes 41 aligned with the valves 12 and has an outwardly flared and frustoconical outer wall 43 that is long enough to project well past the outermost surface of the thickest possible wall. In addition the template 4 has collars 44 that fit back into the ports 11 and nipples 42 aligned with the collars 44 so that a hose can be connected to the template 4.

Once the plate 1 is thus installed it is possible to shut off flow in the passages 121 with the valves 12 to test the upstream connections, and even to open these valves 12 to bleed the system and, if desired, check whether the hot and cold connections are correct, although as discussed below this latter operation is not critical.

After the wall 6 is finished the screws 115 are withdrawn and the template 4 is removed and discarded, the outwardly flaring shape making such removal fairly easy. Then the adapter 3 is mounted with the screws 115 on the fitting 1 and the ring 24 is screwed down over the portion 112.

Subsequently the ring 23 with its screws 231 is dropped down over the sleeve 11 and the extension sleeve 21 is screwed down on the sleeve 11 until it is at the desired axial position. This fitting of the faucet 2 to the adapter 3 and wall fitting 1 automatically connects the incoming ports 121 to the passages 214 and 216. The axial length of the threads on the portion 11*w* therefore define a primary adjustment range for wall thickness. At this time the valves 112 can be opened to make sure that the hot and cold have not been reversed, and hoses can be connected to the nipples 42, if necessary, to catch the water. If they have, the faucet is removed, the adapter 3 is taken off and put back on 180° reversed, and the faucet 2 is reinstalled to reverse the connections. Such initial testing also serves to bleed the lines which frequently contain drops of solder, grit, and the like that can foul the valve or get caught in the faucet strainer.

Then the screws 231 are tightened to lock the faucet 2 solidly in place so that it cannot come unscrewed in normal use. The ring 5 is then slipped over the sleeve 21 until it seats flat on the wall 6. Even if the axis A is not perfectly perpendicular to the wall 6 the fit at the surface 521 will allow it to be tipped and adjusted, and the lip seal 54 will deform to allow such nonperpendicularity without leakage. The ring 5 can move axially quite a bit also to constitute a second range of adjustment for wall thickness.

At any time subsequently it is fairly easy to take off the plate 5 for access to the built-in shutoff valves 12 to limit flow from the faucet, making separate cutoff valves for the installation unnecessary. Similarly removing the faucet 2 and plate 5 gives access to the sound dampers 114 as well as to check valves and filters that can replace the spacer sleeves 116.

We claim:

1. A wall-mount faucet assembly comprising:

a wall fitting adapted to be recessed in a wall and having an externally threaded stem projecting from the wall centered on an axis and formed with hot- and cold-water outlet ports diametrically and symmetrically flanking the axis, the fitting being formed with hot- and cold-water inlet ports behind the wall and connected in the fitting to the outlet ports;

a mixing faucet having an internally threaded collar engageable with the stem and rotatable thereon for axially displacing the faucet on the fitting, the faucet being formed in the collar with concentric inner and outer hot- and cold-water inlets;

an adapter engaged in the collar between the faucet and the fitting and having hot- and cold-water passages with upstream ends at the respective outlet ports diametrically and symmetrically flanking the axis and inner and outer downstream ends at the respective inlets, the downstream ends being concentric such that the inlets connect thereto in any angular position of the faucet on the fitting;

locking means braceable axially between the faucet and the fitting for fixing the faucet on the fitting against rotation thereon in any relative angular position; and an annular cover plate engageable around the collar and against the wall over the locking means to conceal same.

2. A wall-mount faucet assembly comprising:

a wall fitting adapted to be recessed in a wall and having an externally threaded stem projecting from the wall centered on an axis and formed with hot- and cold-water outlet ports, the fitting being formed with hot- and cold-water inlet ports behind the wall;

a mixing faucet having an internally threaded collar engageable with the stem and rotatable thereon for axially displacing the faucet on the fitting, the faucet being formed in the collar with hot- and cold-water inlets connected in the fitting to the outlet ports;

an adapter engaged in the collar between the faucet and the fitting and having hot- and cold-water passages with upstream ends at the respective outlet ports and downstream ends at the respective inlets, the downstream ends being concentric such that the inlets connect thereto in an angular position of the faucet on the fitting; and locking means engageable between the faucet and the fitting for fixing the faucet on the fitting against rotation thereon in any relative angular position.

3. The wall-mount faucet assembly defined in claim 2 wherein the means includes an axially centered generally frustoconical surface on the collar, a ring with a complementary surface engageable with the collar surface, and means for axially bracing the ring against the wall and thereby pressing the surfaces tightly together so as to block rotation of the faucet on the fitting.

4. The wall-mount faucet assembly defined in claim 3 wherein the means for axially bracing includes a plurality of angularly spaced screws threaded through the ring and axially operatively engageable with the fitting.

5. The wall-mount faucet assembly defined in claim 4 wherein the locking means includes another ring threaded on the stem, the screws being axially braced against this other ring.

6. The wall-mount faucet assembly defined in claim 2 wherein the collar has a large-diameter outer end portion formed with the respective thread and an inner smaller-diameter portion, the stem having a large-diameter inner portion formed with the respective thread and an outer smaller-diameter portion juxtaposed with the smaller portion of the collar, a seal being provided between the smaller portions, the adapter further having an inner sleeve defining with the smaller portion of the collar an annular opening constituting one of the downstream ends and internally forming the other downstream end, the collar having an inner sleeve internally delimiting one of the inlets and internally defining the other inlet, the inner sleeves axially telescoping and being provided with a seal.

7. The wall-mount faucet assembly defined in claim 2 wherein the outlet ports of the stem are provided internally with removable sound-damping devices removable via the outlet ports.

8. The wall-mount faucet assembly defined in claim 2 wherein the fitting is provided between each of the inlet port and the respective outlet port with a cutoff valve, the assembly further comprising a cover rosette fixable on the collar and against the wall over the cutoff valves.

9. The wall-mount faucet assembly defined in claim 2 further comprising a cover rosette fixable on the collar and having a seal ring engageable against the wall around the fitting.

10. The wall-mount faucet assembly defined in claim 9 wherein the cover rosette includes a mounting ring snugly engageable over the collar and having a curved outer surface with a center of curvature lying generally on the axis, the rosette including a plate having an inner periphery with an inner edge having a surface complementary to and engaging the curved outer surface of the mounting ring, the plate being tiltable on the mounting ring.

11. The wall-mount faucet assembly defined in claim 2 further comprising a shield engageable over the fitting and formed with nipples engageable with and forming extensions of the outlet ports.

12. The wall-mount faucet assembly defined in claim 2 wherein the outlet ports are symmetrically opposite each other with respect to the axis and the adapter, the adapter being fittable on the stem in 180° offset positions for reversing the connections between the outlet ports and the inlets.

* * * * *